US011224877B2

(12) United States Patent
Mao et al.

(10) Patent No.: US 11,224,877 B2
(45) Date of Patent: Jan. 18, 2022

(54) SYSTEMS AND METHODS FOR ANALYZING DROPLETS

(71) Applicant: a.u. Vista Inc., Milpitas, CA (US)

(72) Inventors: Yuan Mao, Milpitas, CA (US); Tung-Tsun Lin, Milpitas, CA (US)

(73) Assignee: A.U. VISTA INC., Milpitas, CA (US)

( * ) Notice: Subject to any disclaimer, the term of this patent is extended or adjusted under 35 U.S.C. 154(b) by 390 days.

(21) Appl. No.: 16/519,175

(22) Filed: Jul. 23, 2019

(65) Prior Publication Data

US 2021/0023562 A1 Jan. 28, 2021

(51) Int. Cl.
*B01L 3/00* (2006.01)

(52) U.S. Cl.
CPC ..... *B01L 3/502792* (2013.01); *B01L 3/50273* (2013.01); *B01L 2200/16* (2013.01); *B01L 2400/0427* (2013.01)

(58) Field of Classification Search
None
See application file for complete search history.

(56) References Cited

U.S. PATENT DOCUMENTS

| | | | | |
|---|---|---|---|---|
| 8,349,276 | B2 | 1/2013 | Handy | |
| 10,125,393 | B2 | 11/2018 | Esfandyarpour et al. | |
| 2012/0024708 | A1 | 2/2012 | Kaur | |
| 2019/0111433 | A1* | 4/2019 | French | G01R 27/2605 |

* cited by examiner

*Primary Examiner* — J. Christopher Ball
(74) *Attorney, Agent, or Firm* — McClure, Qualey & Rodack, LLP

(57) ABSTRACT

Systems and methods for analyzing droplets are provided. A representative system includes: a substrate; a plurality of scan lines and a plurality of data lines disposed on the substrate to define an array of pixels; a hydrophobic layer disposed on the array of pixels; reagent disposed on the hydrophobic layer; movement control circuitry configured to provide a control signal to a first of the scan lines to move the droplet along the array of pixels to selectively position the droplet in contact with the reagent; position sensing circuitry configured to provide a sensing signal corresponding to a position of the droplet on the array of pixels; and detecting circuitry configured to determine a characteristic of the droplet based on the position of the droplet and a response of the droplet to the reagent.

6 Claims, 11 Drawing Sheets

SYSTEMS AND METHODS FOR ANALYZING DROPLETS

BACKGROUND

Technical Field

The disclosure generally relates to digital microfluidics and, in particular, to electrowetting-on-dielectric applications.

Description of the Related Art

Digital microfluidics utilizing electrowetting-on-dielectric (EWOD) has emerged as a modern paradigm for lab-on-a-chip (LOC) applications owing to numerous perceived advantages. By way of example, EWOD often provides for portability, automation, higher sensitivity and/or higher throughput in diagnosis applications, such as DNA sequencing. However, EWOD applications based on printed circuit board (PCB) and complementary metal-oxide-semiconductor (CMOS) technologies tend to suffer from various shortcomings, such as limited size and lack of transparency, which often requires the use of additional sensors.

Therefore, there is a perceived need for improvements in EWOD applications that address these and/or other perceived deficiencies.

SUMMARY

Systems and methods for analyzing droplets are provided. In an example embodiment, a method comprises: providing a substrate with scan lines and data lines disposed thereon to define an array of pixels, wherein the pixels of the array of pixels have reagent associated therewith; controlling the droplet to move along the array of pixels according to a control signal on a first of the scan lines; detecting a response of the droplet to the reagent according to a sensing signal; and determining a characteristic of the droplet based on a position of the droplet and the response of the droplet.

In some embodiments, detecting the response of the droplet comprises using light to form the sensing signal.

In some embodiments, each of the pixels is associated with a photo diode configured to convert the light into a voltage signal.

In some embodiments, the sensing signal is provided on a first of the data lines.

In some embodiments, detecting the response of the droplet comprises detecting fluorescence associated with the droplet.

In some embodiments, the method further comprises determining a position of the droplet on the array of pixels.

In some embodiments, each of the pixels is associated with a sensing electrode configured to determine a capacitive component corresponding to a portion of the droplet positioned thereon; and determining the position comprises using the capacitance component.

In another example embodiment, a system comprises: a substrate; a plurality of scan lines and a plurality of data lines disposed on the substrate to define an array of pixels; a hydrophobic layer disposed on the array of pixels; reagent disposed on the hydrophobic layer; movement control circuitry configured to provide a control signal to a first of the scan lines to move the droplet along the array of pixels to selectively position the droplet in contact with the reagent; position sensing circuitry configured to provide a sensing signal corresponding to a position of the droplet on the array of pixels; and detecting circuitry configured to determine a characteristic of the droplet based on the position of the droplet and a response of the droplet to the reagent.

In some embodiments, each of the pixels of the array of pixels comprises: a vcom electrode configured to receive a reference voltage; and a sensing electrode configured to receive the response of the droplet to the reagent and to provide a sensing signal corresponding thereto.

In some embodiments, a backlight unit is disposed under the substrate and configured to provide light to illuminate the droplet.

In some embodiments, an optical sensor is configured to provide a read-out voltage in accordance with a response of the droplet to the light.

In some embodiments, a color filter is disposed on the optical sensor.

In some embodiments, each of the pixels is associated with a photo diode configured to convert light, associated with the droplet, into a voltage signal; and the detecting circuitry is further configured to use the voltage signal to determine the response of the droplet to the reagent.

In some embodiments, each of the pixels is associated with a sensing electrode configured to determine a capacitive component corresponding to a portion of the droplet positioned thereon; and the position sensing circuitry is further configured to use the capacitive component to form the sensing signal.

In some embodiments, each of the pixels of the array of pixels comprises: a first thin film transistor (TFT) electrically connected between a corresponding one of the plurality of scan lines and a corresponding control electrode; and a second TFT electrically connected between a corresponding one of the plurality of data lines and a corresponding sensing electrode.

In another example embodiment, a panel comprising a plurality of pixel structures for analyzing a droplet, each of the pixel structures comprises: a first scan line, disposed in a first direction for receiving a first driving voltage to move the droplet; a data line, disposed in a second direction for receiving a high frequency pulse, wherein the first direction is perpendicular to the second direction; a second scan line, disposed in the first direction for receiving a second driving voltage; a readout line, disposed in the second direction for sensing a position of the droplet; a first transistor, having a first end being connected to the data line, a second end being connected to a control electrode, and a control end being connected to the first scan line; and a second transistor, having a first end being connected to the readout line, a second end being connected to a sense unit, and a control end being connected to the second scan line.

In some embodiments, for each of the pixel structures: the first scan line, the data line and the first transistor are formed in an array layer on a bottom substrate; and the second scan line, the readout line and the second transistor are formed in an array layer on a top substrate, wherein the droplet is located between the top layer and the bottom layer.

In some embodiments, each of the pixel structures further comprises a color filter layer, wherein a projection area of the color filter layer is covered by the sense unit.

In some embodiments, each of the pixel structures further comprises a common electrode, disposed under the control electrode in the first direction for providing a reference voltage.

In some embodiments, the common electrode is disposed under the control electrode and the sense unit.

In some embodiments, in a moving period, the first driving voltage is provided to the first scan line to move the droplet; and in a position determining period, the second driving voltage is provided to the second scan line, and the readout line senses the voltage difference of the sense unit.

Other objects, features, and/or advantages will become apparent from the following detailed description of the preferred but non-limiting embodiments. The following description is made with reference to the accompanying drawings.

DETAILED DESCRIPTION

For ease in explanation, the following discussion describes several embodiments of systems and methods for analyzing droplets. It is to be understood that the invention is not limited in its application to the details of the particular arrangements shown since the invention is capable of other embodiments. Also, the terminology used herein is for the purpose of description and not of limitation.

In this regard, various systems and methods for analyzing droplets may address the aforementioned challenges by providing EWOD-based systems and methods that are able to handle many droplets simultaneously on a substrate. As will be described in greater detail below, in some embodiments, this may be accomplished by incorporating provisions for continuously monitoring droplet parameters, such as position, size, and/or velocity.

Figure 1:
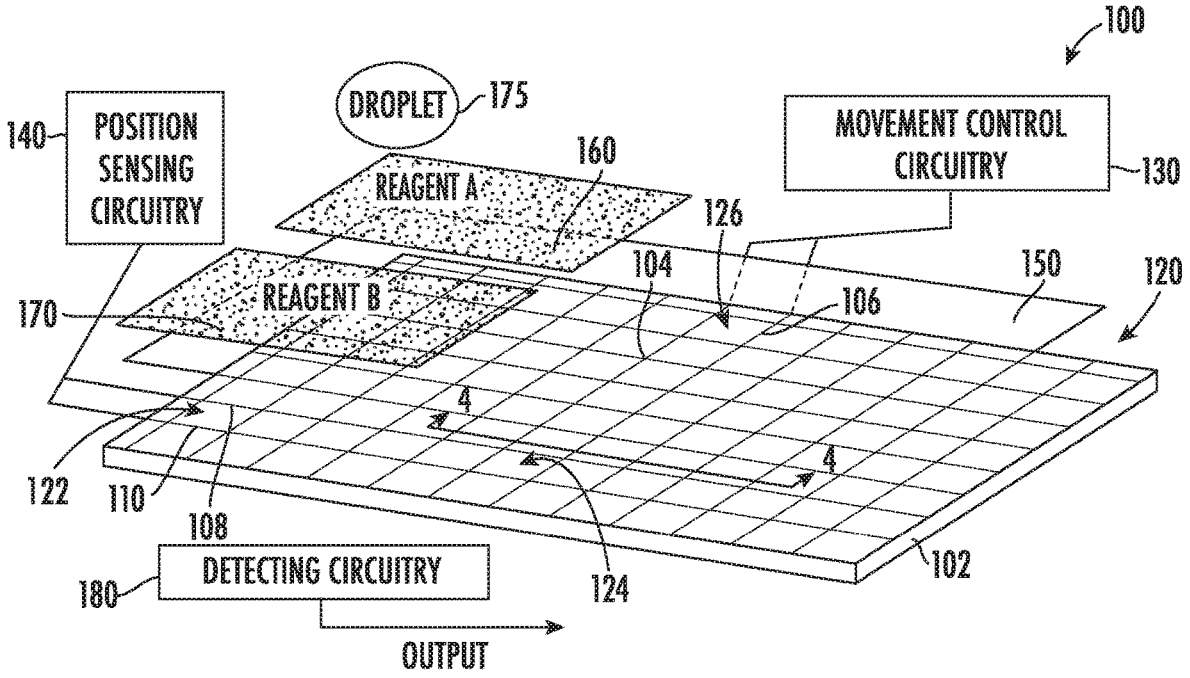
FIG. 1 is a schematic diagram of a portion of an embodiment of a system for analyzing droplets.

Preferred embodiments will now be described with reference to the drawings. In particular, FIG. 1 depicts a portion of an embodiment of a system 100, which includes a substrate 102. A plurality of scan lines (e.g., scan lines 104 and 106) and a plurality of data lines (e.g., data lines 108 and 110) are disposed on substrate 102 to define an array of pixels 120, which incorporates a plurality of pixels (typically thousands of pixels, e.g., pixels 122, 124, 126) arranged in rows and columns. For ease in illustration, only a few pixels are illustrated in FIG. 1.

Each pixel (or pixel circuit) is coupled to at least one scan line and at least one data line. By way of example, pixel 124 is electrically coupled to scan lines 104 and 106 and to data lines 108 and 110. Movement control circuitry 130 and position sensing circuitry 140 are configured to control signals (e.g., voltage signals) on the respective scan and data lines to address each pixel. Additionally, a hydrophobic layer 150 is disposed on array of pixels 120, and reagent (e.g., Reagent A (160) and Reagent B (170)) is disposed on hydrophobic layer 150.

Movement control circuitry 130 is configured to provide control signals to the scan lines to move droplets (e.g., droplet 175) along array of pixels 120 to selectively position the droplets in contact with one or more of reagents disposed on hydrophobic layer 150. Position sensing circuitry 140 is configured to provide a sensing signal corresponding to a position of the droplets on array of pixels 120. Notably, in some embodiments, capacitive characteristics of a droplet on the array of pixels 120 may be used for providing the sensing signal, whereas, in other embodiments, optical characteristics of a droplet may be used. Detecting circuitry 180 also is provided. Detecting circuitry 180 is configured to determine a characteristic of the droplet based on the position of the droplet (such as determined by position sensing circuitry 140) and a response of the droplet to a reagent to which the droplet may have responded (e.g., reacted). For instance, in some embodiments, detecting circuitry may be associated with a camera (e.g., a CCD) that is configured to determine a characteristic (e.g., color) of the droplet, which may be a mix of a sample and one or more reagents.

Because of electro-wetting characteristics of the droplet, movement control circuitry 130 may provide a high voltage level control signal to scan line 310 in order to control the y-direction movement of the droplet; and provide the high voltage level control signal to data line 330 in order to control the x-direction movement of the droplet. While the droplet is moved to a region to mix with the reagents, detecting circuitry 180 can determine one or more characteristics of the droplet. Position sensing circuitry 140 may provide driving signals to scan lines 312 sequentially. When the droplet is located on the projection region of the pixel, the corresponding data lines 312 may readout the voltage difference of the pixel electrode and the Vcom electrode in order to determine the position of the droplet.

Figure 2:
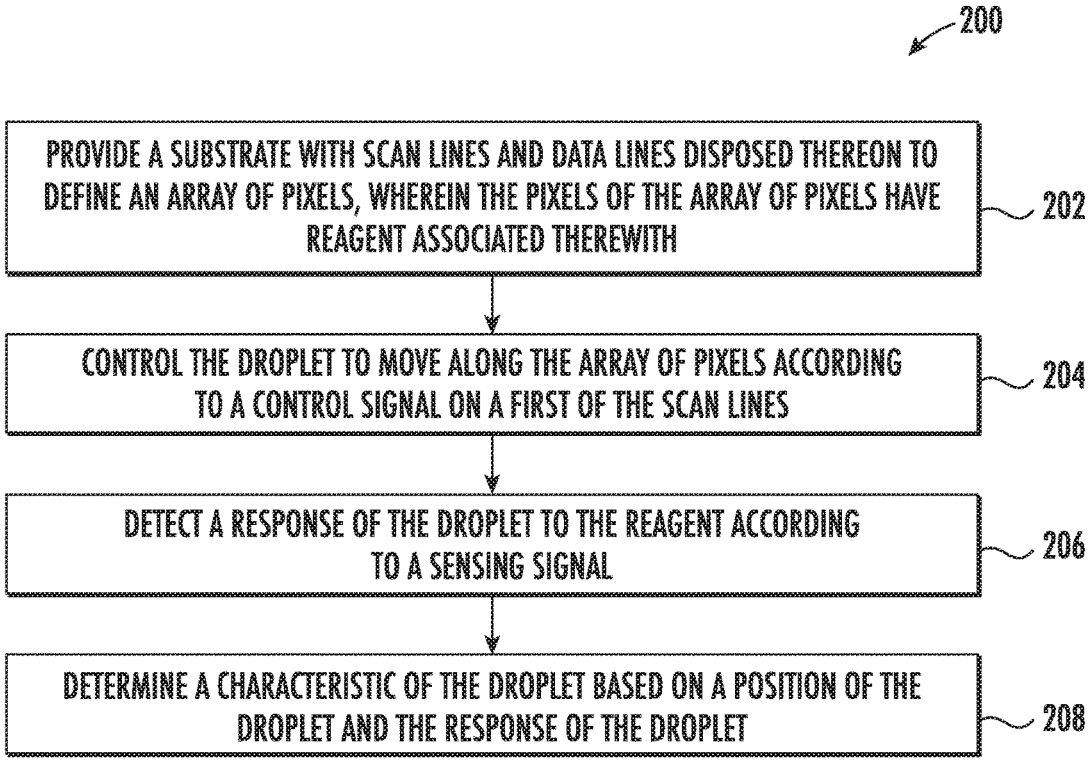
FIG. 2 is a flowchart depicting an embodiment of a method for analyzing droplets.

In this regard, an embodiment of a method, such as may be performed by system 100 of FIG. 1, is shown in FIG. 2. In FIG. 2, method 200 involves providing a substrate with scan lines and data lines disposed thereon to define an array of pixels, wherein the pixels of the array of pixels have reagent associated therewith (block 202). In block 204, a droplet is controlled to move along the array of pixels according to a control signal on a first of the scan lines (such as may be performed by movement control circuitry). In block 206, a response of the droplet to the reagent is detected according to a sensing signal. In some embodiments, the sensing signal is provided on a first of the data lines. Thereafter, such as depicted in block 208, a characteristic of the droplet is determined based on a position of the droplet (such as determined by position sensing circuitry) and the response of the droplet. The characteristic may be provided in the form of an output (e.g., a digital output signal from the system).

Figure 3:
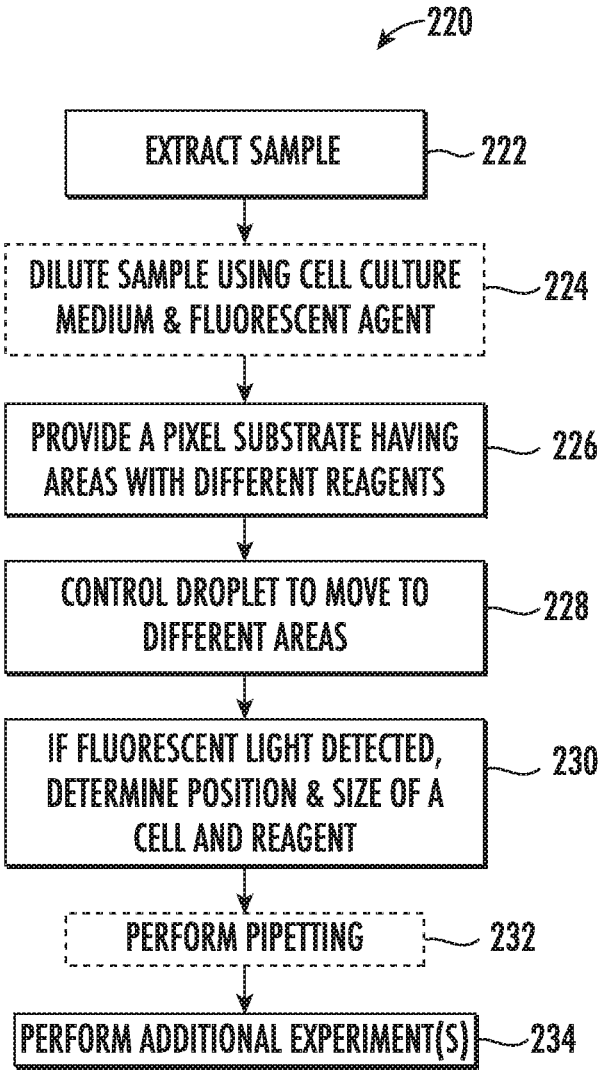
FIG. 3 is a flowchart depicting another embodiment of a method for analyzing droplets.

FIG. 3 is a flowchart 220 depicting another embodiment of a method for analyzing droplets. As shown in FIG. 3, in which optional steps/functions are depicted in dashed lines), a sample is extracted in block 222. For instance, the sample may be a blood sample extracted from a patient. In block 224, the sample is optionally diluted using a cell culture medium and a fluorescent agent. A pixel substrate (i.e., a substrate with an array of pixels disposed thereon) is provided that has areas with different reagents (block 226). In block 228, a droplet of the sample is controlled to move to different areas of the pixel substrate in order to interact with one or more of the reagents. Thereafter, such as depicted in block 230, if fluorescent light associated with the droplet is detected, position and size of a cell corresponding to the droplet is determined. Notably, determining the position also assists in identifying the reagent that is the likely cause of the fluorescence. In block 232, pipetting may be performed. For example, a user may use a pipette to move the droplet of the sample on the pixel substrate to another analyzing device. That is, the sample (now potentially mixed with different reagents) may be pipette to another device to continue other analysis, such as DNA sequencing. Then, as shown in block 234, one or more additional experiments may be performed. By way of example, DNA sequencing may be performed.

Figure 4:
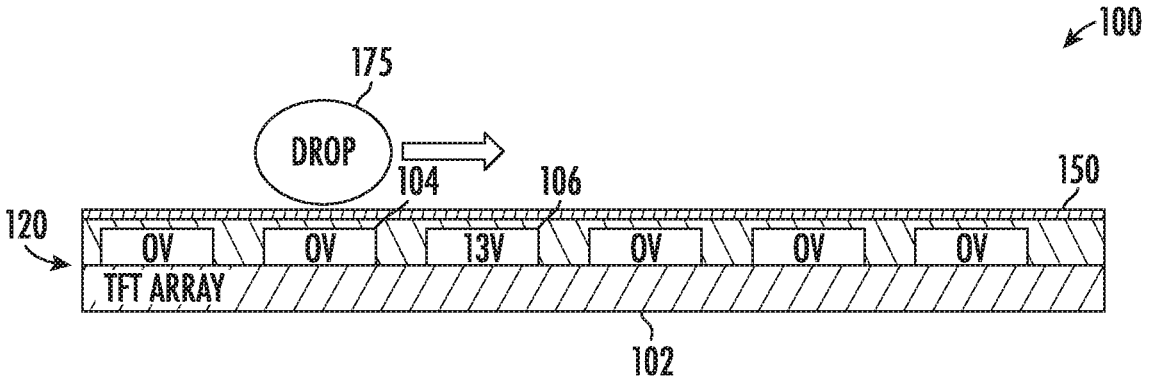
FIG. 4 is a schematic, cross-sectional view of a portion of the embodiment of the system of FIG. 1.

FIG. 4 is a schematic, cross-sectional view of a portion of system 100 of FIG. 1. In particular, FIG. 1 shows operation of system 100 in controlling movement of droplet 175 (which may include a cell culture medium and a fluorescent agent, e.g., phosphorous) across the surface of hydrophobic layer 150. Note that to control movement of droplet 175, movement control circuitry (not shown in FIG. 4) provides a control signal to scan line 106. In this embodiment, the control signal energizes scan line 106 to exhibit a selected voltage (e.g., 13V), which attracts droplet 175 to move in the direction indicated by the arrow. Thus, by addressing one or more of the scan lines with a control signal, movement of one or more droplets may be controlled.

Figure 5A:
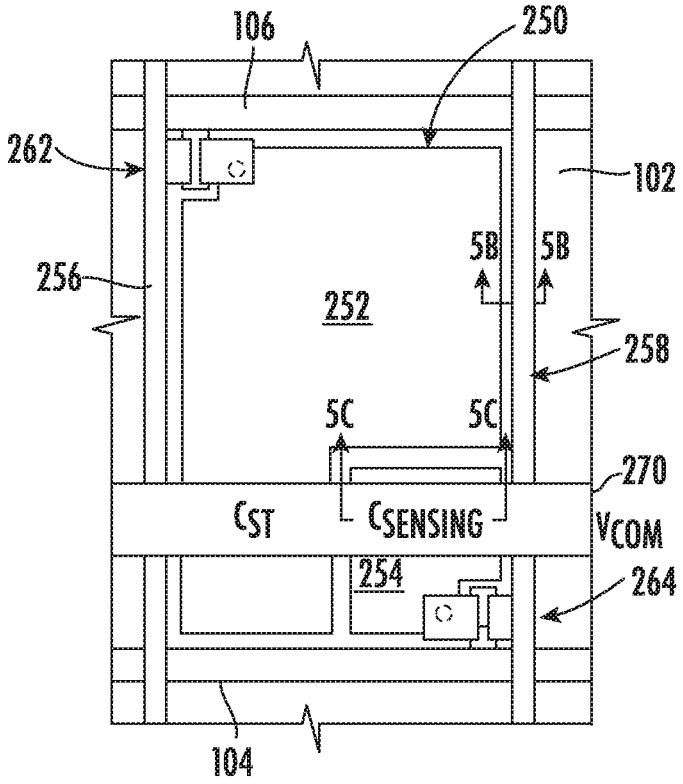
FIG. 5A is a schematic, plan view of a pixel of an embodiment of a system for analyzing droplets.

FIG. 5A is a schematic, plan view of an embodiment of a pixel 250 that may be positioned between scan lines 104 and 106 of the system embodiment of FIGS. 1 and 4. As shown in FIG. 5A, a portion of substrate 102 is depicted upon which pixel 250 is disposed. Pixel 250 includes transparent electrodes. In particular, pixel 250 incorporates a control electrode 252 and a sensing electrode 254, each which is associated with a corresponding data line and scan line, as well as a thin film transistor. Specifically, control electrode 252 is associated with scan line 106, data line 256 and thin film transistor (TFT) 262, and sensing electrode 254 is associated with scan line 104, data line 258 and TFT 264. Additionally, a common (Vcom) electrode 270 is provided which extends over both control electrode 252 and sensing electrode 254 to form capacitive elements. In operation, the presence and/or absence of a droplet on pixel 250 is determined by measuring a capacitance component between sensing electrode 254 and Vcom electrode 270. Voltage differences corresponding to droplet parameters may then be determined by sensing circuitry.

Figure 5B:
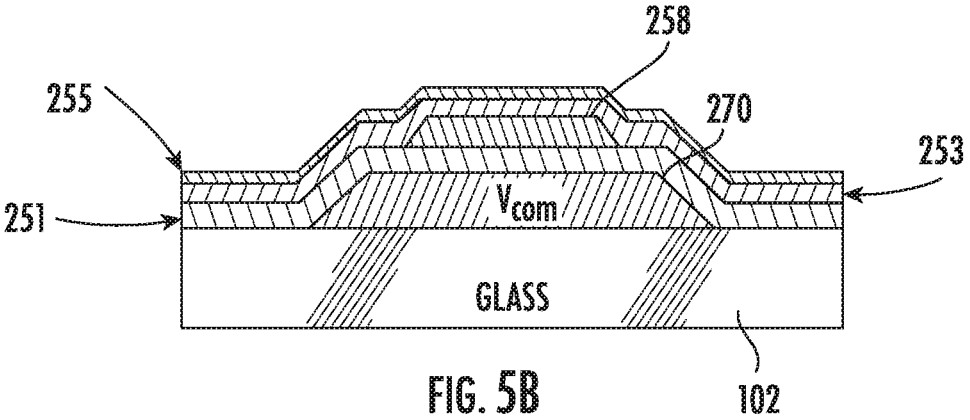
FIG. 5B is a schematic, cross-sectional view of a portion of the pixel of FIG. 5A.

FIG. 5B depicts a portion of pixel 250 of FIG. 5A as viewed along section line 5B-5B. As shown in FIG. 5B, the portion of pixel 250 along section line 5B-5B is the sensing-readout portion. A semiconductor layer (e.g., gate insulator 251) is formed on the array substrate 102. A passivation layer 253 (e.g., ILD) is formed and data line (SD) 258 is formed in a metal layer. A hydrophobic layer 255 covers the structure.

Figure 5C:
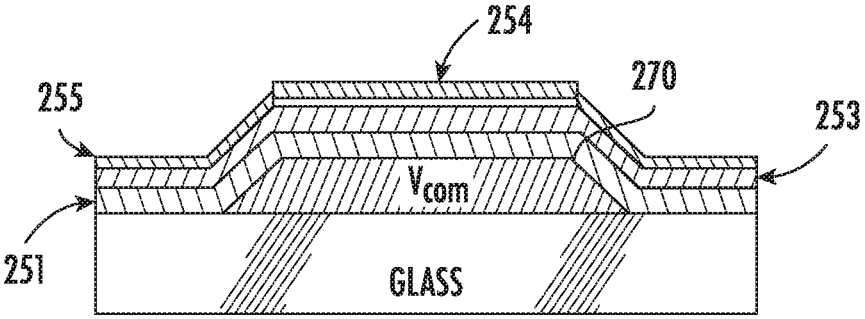
FIG. 5C is a schematic, cross-sectional view of another portion of the pixel of FIG. 5A.

FIG. 5C depicts another portion of pixel 250 of FIG. 5A as viewed along section line 5C-5C. As shown in FIG. 5C, the portion of pixel 250 along section line 5C-5C is the sensing portion. The semiconductor layer is formed on the array substrate, ILD is the passivation layer, the control electrode 252 and the sensing electrode 254 could be formed in ITO.

Figure 6A:
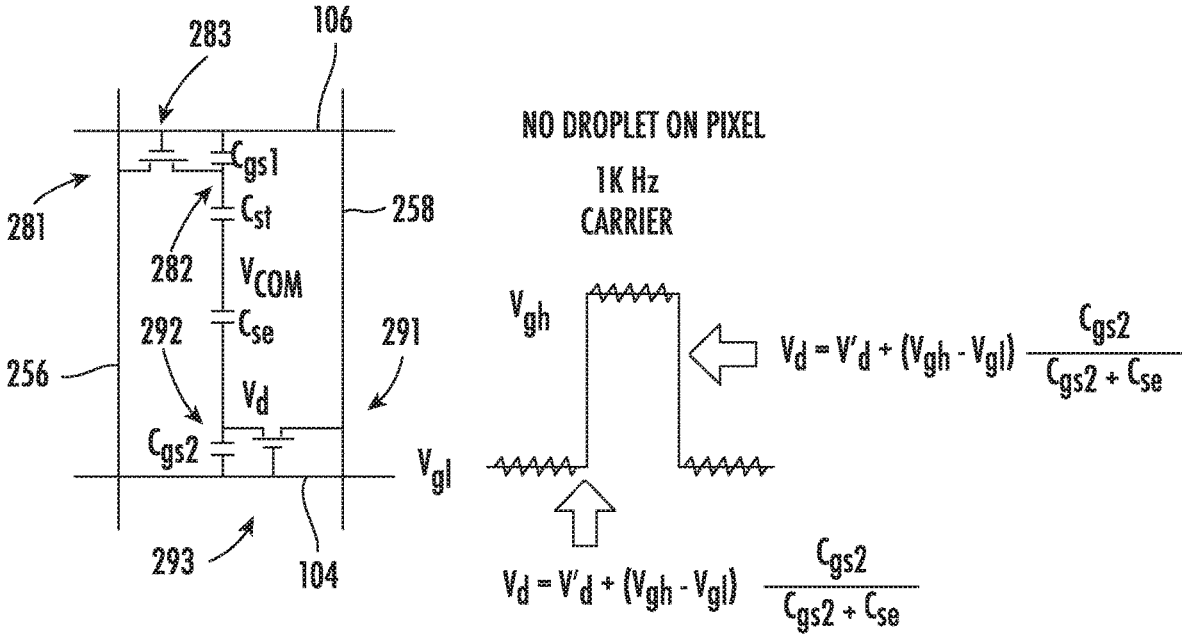
FIG. 6A is an equivalent circuit diagram of the pixel of FIG. 5A representative of no droplet being on the pixel.

FIG. 6A depicts an equivalent circuit of pixel 250 of FIG. 5A. Notably, TFT 262 and TFT 264 have a control end, a first end, and a second end, respectively. In particular, first end 281 of TFT 262 is connected to the data line 256, second end 282 of TFT 262 is connected to control electrode 252, and control end 283 of TFT 262 is connected to scan line 106. First end 291 of TFT 264 is connected to sensing line 258, second end 292 of TFT 264 is connected to sensing electrode 254, and control end 293 of TFT 264 is connected to scan line 104.

Figure 6B:
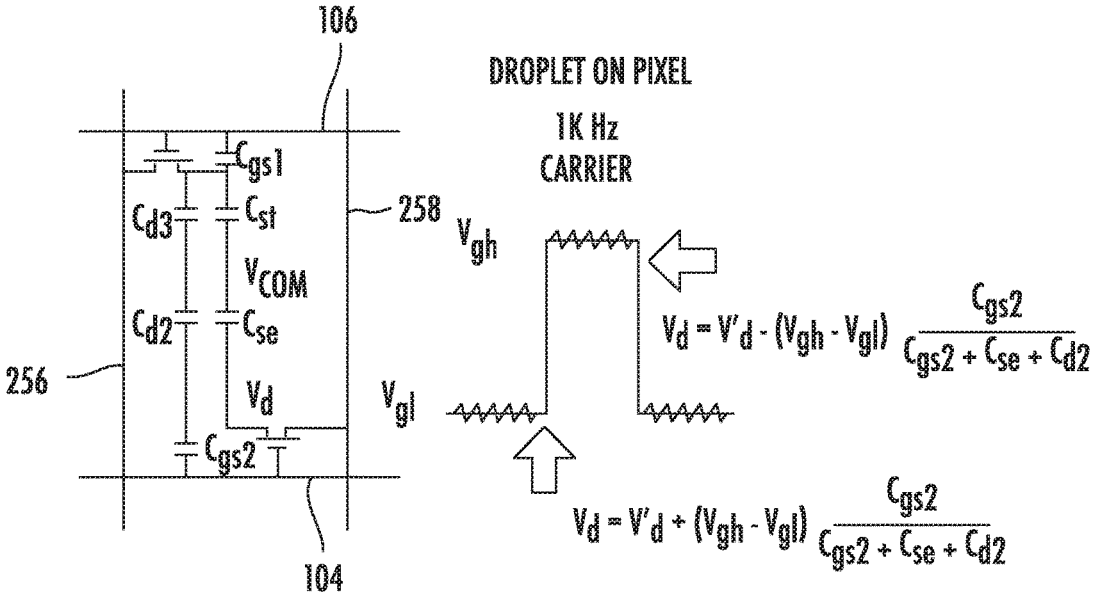
FIG. 6B is an equivalent circuit diagram of the pixel of FIG. 5A representative of a droplet being on the pixel.

In operation, scan line 106 receives a pulse signal as depicted in FIG. 6A to activate TFT 262, and data line 256 receives a high duty (1 KHz) pulse DC signal in order to control movement of the droplet. Scan line 104 receives a high frequency (1 KHz) carrier signal for differentiating the sensing signal from noise in the environment. If there is no droplet on the pixel area, the equivalent circuit could be as depicted in FIG. 6A. Specifically, a capacitance Cst is introduced between the control electrode and Vcom electrode, and a capacitance Cse is introduced between the sensing electrode and Vcom electrode. If there is a droplet on the pixel area, the equivalent circuit could be as depicted in FIG. 6B. Specifically, capacitance Cd1 and Cd2 are further introduced between TFT 262 and Vcom electrode, and between TFT 264 and Vcom electrode.

Figure 7:
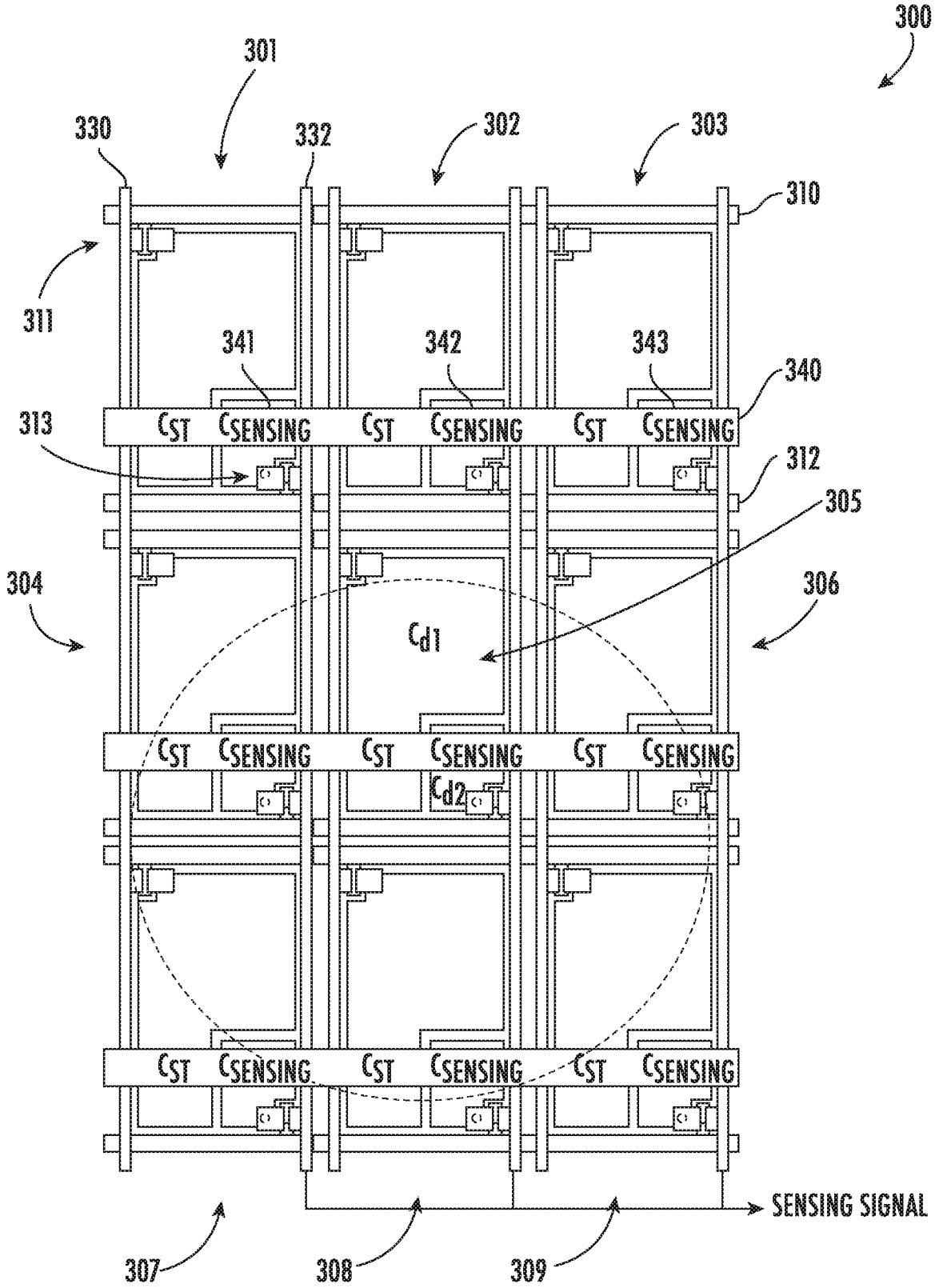
FIG. 7 is a schematic, plan view of an array of pixels of an embodiment of a system for analyzing droplets.

FIG. 7 depicts an embodiment of an array of pixels. As shown in FIG. 7, array 300 incorporates multiple pixels (e.g., pixels 301-309) that are configured similar to that of pixel 250 of FIG. 5. It should be noted, however, that other embodiments of an array of pixels may use pixels of alternative configurations. In array 300, each pixel is electrically connected to two scan lines and two data lines, with one of the scan lines and one of the data lines being associated with a corresponding one of two TFTs. For instance, pixel 301 is electrically connected to scan lines 310 and 312 and data lines 330 and 332, with scan line 310 and data line 330 being associated with TFT 311 and scan line 312 and data line 332 being associated with TFT 313. Additionally, array 300 includes Vcom electrodes that span across the pixels and are disposed in an overlying relationship with sensing electrodes of the pixels. For example, Vcom electrode 340 spans across sensing electrodes 341-343 of pixels 301-303, respectively.

In one embodiment, a plurality of pixels (e.g., those configured as pixel 250) is formed into a matrix. The scan lines 310 and the data lines 330 could be enabled sequentially. Hence, a droplet is controlled by providing driving voltages to the scan lines 310 and the data lines 330 in order to move the droplet. Specifically, a voltage difference created between adjacent lines (and pixels) generates an electric filed that urges the droplet to move. For example, the droplet could be moved into a specific region to mix with a desired reagent.

FIG. 7 depicts operation of pixel 250 of FIG. 5 in a moving period, during which movement control circuitry may provide driving voltages to scan lines 310 and driving voltages to data lines 330 sequentially to enable the control electrodes for controlling movement of the droplet. In this embodiment, Vcom electrode 340 is provided at a fixed reference voltage. Because of electro-wetting characteristic of the droplet, a voltage signal (e.g., a high voltage level signal) is provided to scan line 310 in order to control the y-direction movement of the droplet; and a high duty (e.g., 1 KHz) pulse DC signal is provided to data line 330 in order to control the x-direction movement of the droplet.

In a sensing period, scan lines 312 are enabled and Vcom electrode 340 is provided at a fixed reference voltage. Voltage differences may be different between each of the sensing electrode of pixels 301-309 and the Vcom electrode 340. For example, when the droplet is located on the pixel 305, a voltage difference is exhibited between the sensing electrode of pixels 305 and the Vcom electrode 340; when the droplet is not located on the pixel 309, no voltage difference may be exhibited between the sensing electrode of pixels 309 and the Vcom electrode 340.

In one embodiment, the moving period may overlap with the sensing period. That is, while scan lines 310 control the droplet to move, scan lines 312 detect the position of the droplet.

In another embodiment, scan lines 312 could be enabled sequentially. When scan line 312 is enabled, a corresponding data line 332 (or "readout line") of the sensing pixel senses a voltage difference, which is exhibited between the sensing electrode of pixel and the Vcom electrode 340, and provided to the detecting circuitry (sensor IC). For example, when the droplet is located on the pixel 305, a voltage difference is exhibited between the sensing electrode of pixels 305 and the Vcom electrode 340, then the detecting circuitry may sense the voltage difference through the data line 332; when the droplet is not located on the pixel 309, no voltage difference is exhibited between the sensing electrode of pixels 309 and the Vcom electrode 340, then the detecting circuitry may not sense a voltage difference through the data line 332.

Figure 8:
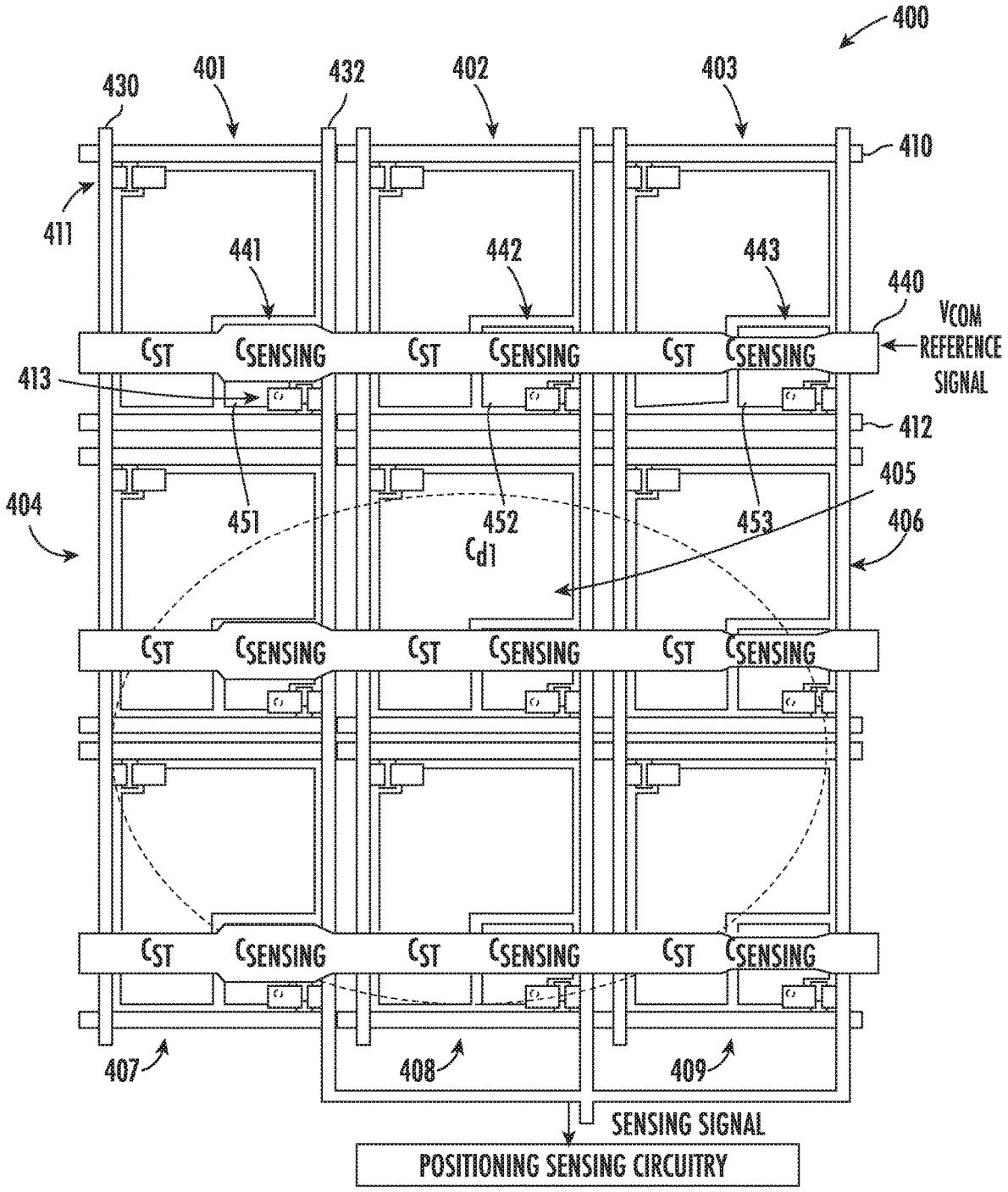
FIG. 8 is a schematic, plan view of an array of pixels of another embodiment of a system for analyzing droplets.

FIG. 8 depicts another embodiment of an array of pixels. As shown in FIG. 8, array 400 incorporates multiple pixels (e.g., pixels 401-409). In array 400, each pixel is electrically connected to two scan lines and two data lines, with one of the scan lines and one of the data lines being associated with a corresponding one of two TFTs. For instance, pixel 401 is electrically connected to scan lines 410 and 412 and data lines 430 and 432, with scan line 410 and data line 430 being associated with TFT 411 and scan line 412 and data line 432 being associated with TFT 413. Unlike the embodiment of FIG. 7, array 400 incorporates Vcom electrodes that vary in configuration among adjacently disposed pixels. By way of example, Vcom 440, which is associated with pixels 401-403, exhibits varying widths at positions corresponding to the sensing electrodes of the pixels. Specifically, portion 441 (which is in an overlying relationship with sensing electrode 451 of pixel 401) is wider than portion 442 (which is in an overlying relationship with sensing electrode 452 of pixel 402), which is wider than portion 443 (which is in an overlying relationship with sensing electrode 453 of pixel 403).

In one embodiment, the positioning sensing circuitry might be implemented by digital signal processor (DSP). Data lines 432 of sensing pixels are electrically connected to the positioning sensing circuitry. While scan lines 412 are inactivated, sensing lines 432 may read out the voltage level (A) of each sensing pixel; while scan lines 412 are activated, sensing lines 432 may read out voltage level (B) of each sensing pixel. Positioning sensing circuitry decodes voltage differences (|B−A|) of the sensing pixel when there is a droplet on the sensing pixel.

Figure 9:
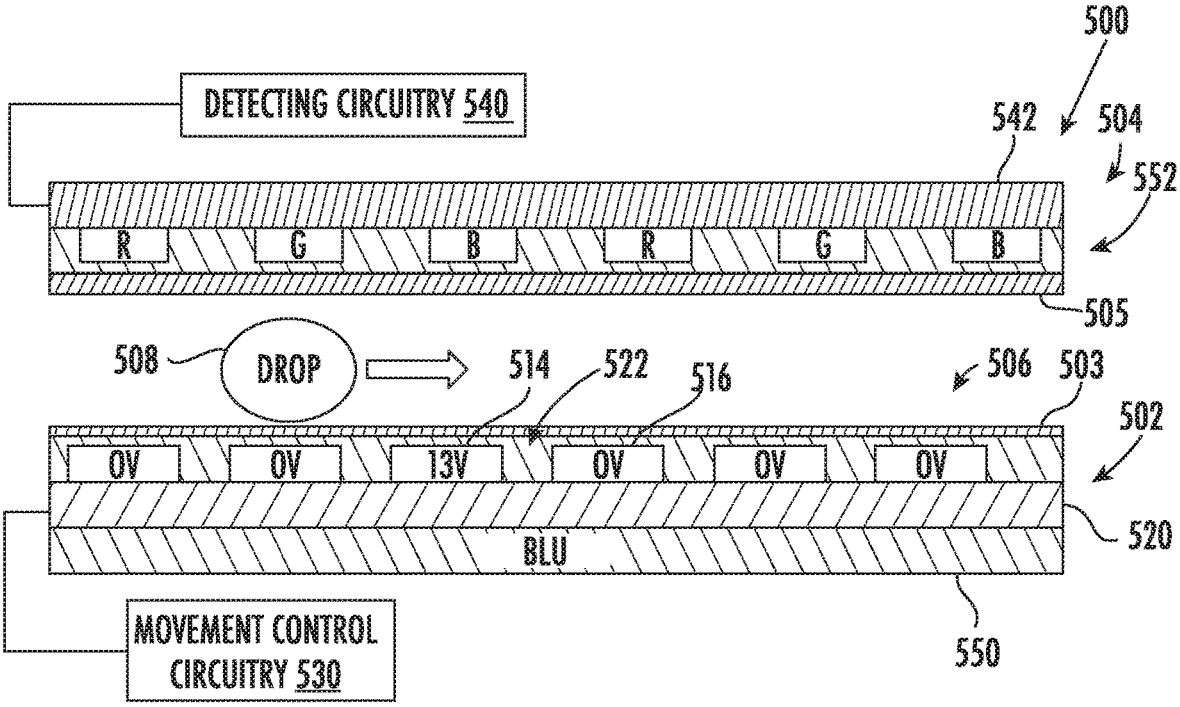
FIG. 9 is a schematic, cross-sectional view of a portion of another embodiment of a system for analyzing droplets.

FIG. 9 is a schematic, cross-sectional view of a portion of another embodiment of a system for analyzing droplets. As shown in FIG. 9, system 500 incorporates a bottom section 502 and a top section 504, which is spaced from and in an overlying relationship with bottom section 502 to define a channel 506 through which one or more droplets (e.g., droplet 508) may move under control of bottom section 502. Note that both bottom section 502 and top section 504 incorporate hydrophobic layers 503 and 505, respectively, adjacent to channel 506.

Similar to that described previously with respect to FIG. 1, for example, bottom section 502 includes a plurality of scan lines (e.g., scan lines 514 and 516) and a plurality of data lines (not specifically shown but inherent in TFT array 520) that define an array of pixels (e.g., pixel 522) arranged in rows and columns. In operation, and under control of movement control circuitry 530, the scan lines are selectively energized to control the movement of droplets through channel 508 as depicted by the arrow.

In this embodiment, detecting circuitry 540 is associated with top section 504 and includes functions previously attributed to position sensing circuitry; specifically, that of determining a position of the droplet on the array of pixels. In this regard, top section 504 incorporates an optical sensor 542 that is configured similar to that of TFT array 520 with respect to the inclusion of scan and data lines. However, in optical sensor 520, each pixel location incorporates a photodiode that is configured to provide a read-out voltage in accordance with a response of a droplet to light. Notably, in this embodiment, light is provided by a backlight unit 550 associated with bottom section 502. So configured, optical sensor 542 is configured to convert light (which may be filtered by color filter 552) into a voltage signal that is used by detecting circuitry 540 to determine the position and/or response of a droplet to a reagent, which may be disposed in channel 508. In some embodiments, the response of a droplet may include fluorescing, in which case, the optical sensor may detect the fluorescence associated with the droplet, such as after light from backlight unit 550 has been turned off.

Figure 10:
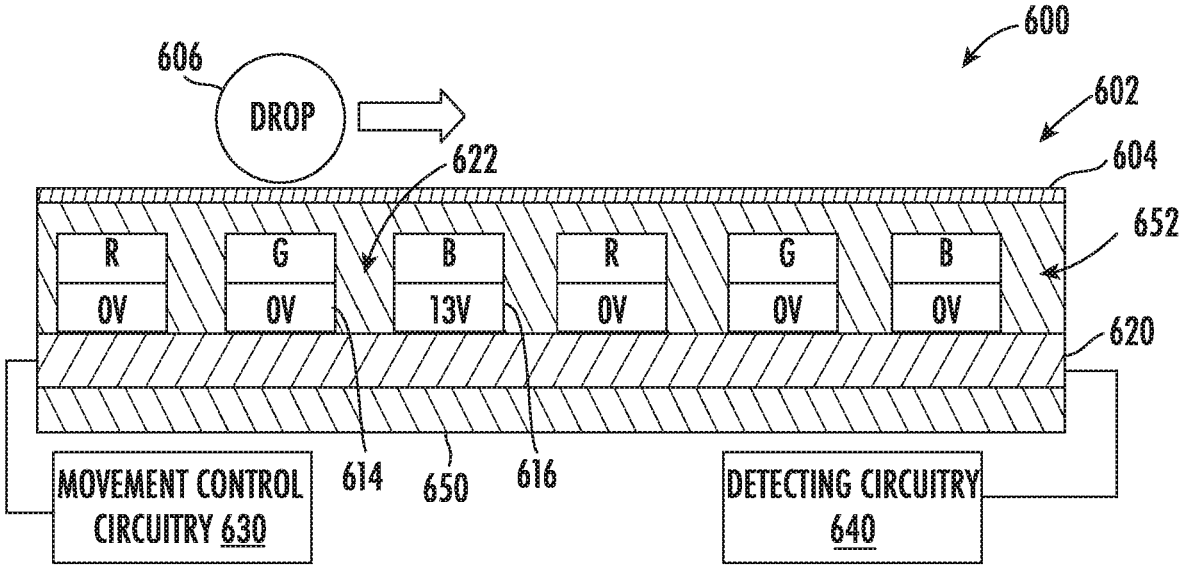
FIG. 10 is a schematic, cross-sectional view of a portion of another embodiment of a system for analyzing droplets.

FIG. 10 shows a portion of another embodiment of a system for analyzing droplets. In FIG. 10, system 600 incorporates a section 602 with a hydrophobic layer 604 upon one or more droplets (e.g., droplet 606) may move under control of movement control circuitry 510. Although not depicted, it should be understood that bottom section 802 may be used with a corresponding top section, which is used to define a channel through which a droplet may be moved. Similar to that described previously, section 602 includes a plurality of scan lines (e.g., scan lines 614 and 616) and a plurality of data lines (not specifically shown but inherent in TFT array 620) that define an array of pixels (e.g., pixel 622) arranged in rows and columns. In operation, and under control of movement control circuitry 630, the scan lines are selectively energized to control the movement of droplets as depicted by the arrow.

In this embodiment, detecting circuitry 640 is associated with section 602 and includes functions previously attributed to position sensing circuitry; specifically, that of determining a position of the droplet on the array of pixels. In this regard, section 602 incorporates an optical sensor within TFT array 620 that incorporates a photodiode at each pixel location. Light is provided by a backlight unit 650. So configured, the optical sensor is configured to convert light (which may be filtered by color filter 652) into a voltage signal that is used by detecting circuitry 640 to determine the position and/or response of a droplet to a reagent.

Figure 11:
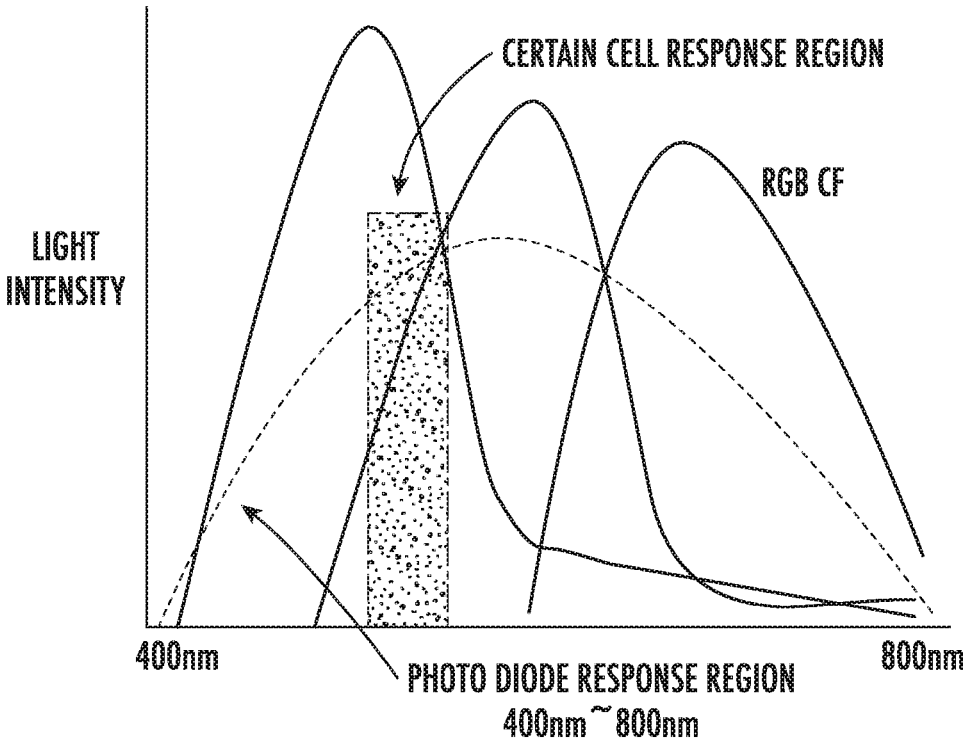
FIG. 11 is a graph depicting representative photodiode response (light intensity versus wavelength).

FIG. 11 is a graph depicting representative photodiode response (light intensity versus wavelength) associated with an embodiment of a system that uses optical sensing for analyzing droplets (such as the embodiment of FIG. 10, for example).

Figure 12:
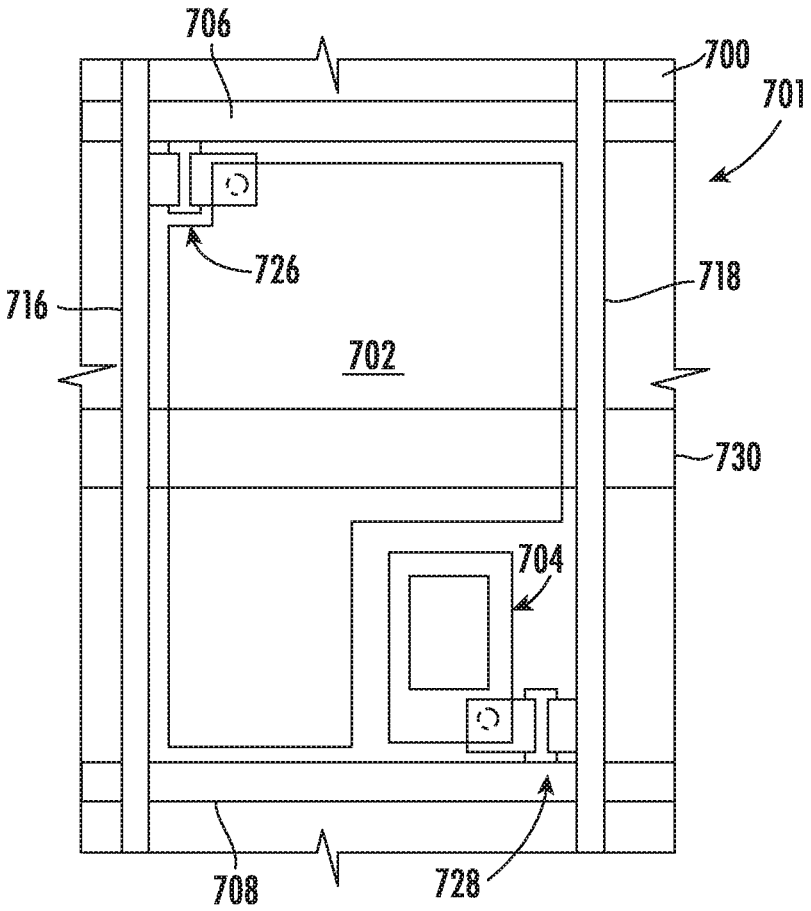
FIG. 12 is a schematic, plan view of a pixel of an embodiment of a system for analyzing droplets.

FIG. 12 shows an embodiment of a pixel, such as may be positioned between scan lines 614 and 616 of the embodiment of FIG. 10, for example. As shown in FIG. 12, a portion of a substrate 700 is depicted upon which pixel 701 is disposed. Pixel 701 includes a transparent control electrode 702 and a photodiode 704, each which is associated with a corresponding data line and scan line, as well as a thin film transistor. Specifically, control electrode 702 is associated with scan line 706, data line 716 and TFT 726, and photodiode 704 is associated with scan line 708, data line 718 and TFT 728. Additionally, a common (Vcom) electrode 730 is provided which extends over control electrode 702 to form a capacitive element. In operation, the presence and/or absence of a droplet on pixel 701 is determined by detecting the presence of and/or analyzing light incident upon the photodiode. Notably, the combination of a sample (e.g., an abnormal cell) and reagent generates light. Only certain wavelength of the light is able to pass through a color filter, and the certain wavelength is incident upon the photodiode owing to reflection of the light by the droplet. Wavelength and corresponding characteristics may then be determined. Through voltage differences, the photodiode can also be used to sense droplet location.

Figure 13:
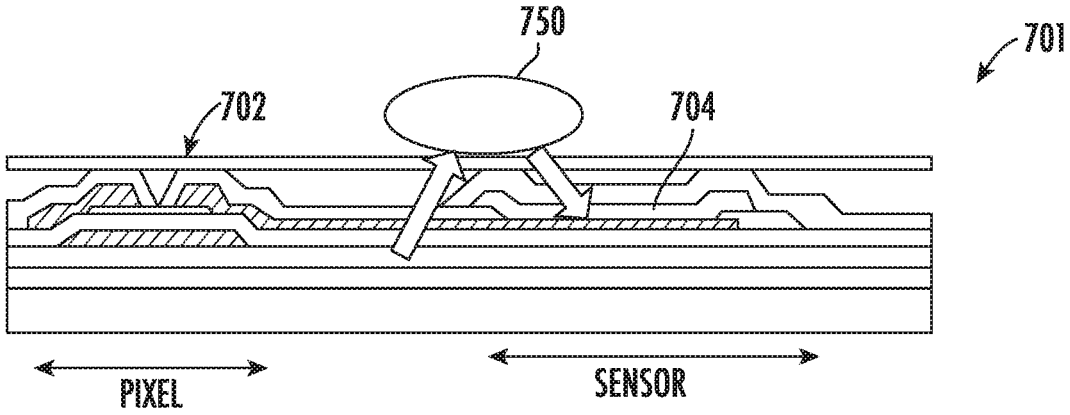
FIG. 13 is a schematic, cross-sectional view of a portion of another embodiment of a system for analyzing droplets.

FIG. 13 is a schematic, cross-sectional view of a portion of the embodiment of FIG. 12. As shown in FIG. 13, a system for analyzing droplets. In FIG. 13, pixel 701 is shown with an associated hydrophobic layer 740 and a backlight unit 742. Backlight unit 742 emits light (depicted by the arrows), which propagates through pixel 701 and hydrophobic layer 740 and is reflected by a droplet 750. The reflected light is sensed by photodiode 704.

Figure 14:
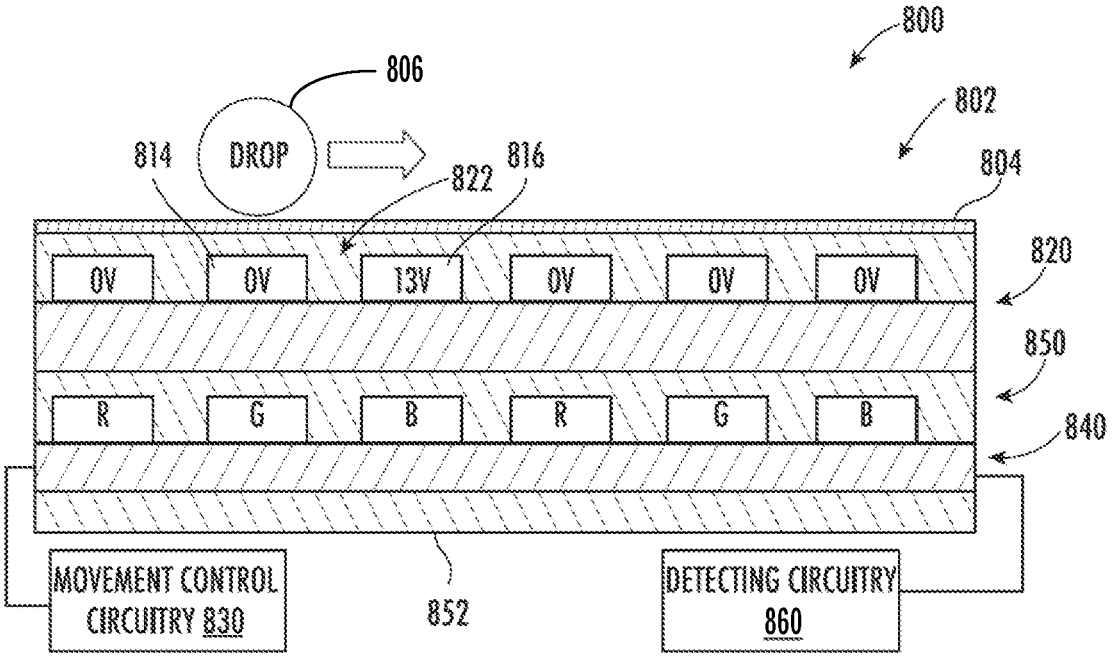
FIG. 14 is a schematic, cross-sectional view of a portion of another embodiment of a system for analyzing droplets.

FIG. 14 shows a portion of another embodiment of a system for analyzing droplets. In FIG. 14, system 800 incorporates a bottom section 802 with a hydrophobic layer 804 upon one or more droplets (e.g., droplet 806) may move under control of movement control circuitry 510. Although not depicted, it should be understood that bottom section 802 may be used with a corresponding top section, which is used to define a channel through which a droplet may be moved. Similar to that described previously, section 802 includes a plurality of scan lines (e.g., scan lines 814 and 816) and a plurality of data lines (not specifically shown but inherent in TFT array 820) that define an array of pixels (e.g., pixel 822) arranged in rows and columns. Movement control circuitry 830 is configured to selectively energize the scan lines to control the movement of droplets as depicted by the arrow.

Disposed below TFT array 820 is a TFT array 840, which incorporates an optical sensor that includes an array of photodiodes. A color filter 850 is disposed between TFT array 840 and TFT array 820. Additionally, a backlight unit 852 disposed below TFT array 840 is configured to illuminate the droplets. In operation, detecting circuitry 860 is configured to receive a voltage signal from the photodiodes that corresponds to response of a droplet to light from backlight unit 852.

It should be noted that the aforementioned circuitry (circuits) and functions of various embodiments may be implemented by hardware, software or a combination of hardware and software such as microcontrollers, application-specific integrated circuits (ASIC) and programmable microcontrollers, as well as by circuits that may be implemented by TFT array processes, such as gate driver circuitry on array (GOA).

The embodiments described above are illustrative of the invention and it will be appreciated that various permutations of these embodiments may be implemented consistent with the scope and spirit of the invention.

What is claimed is:

1. A panel comprising a plurality of pixel structures for analyzing a droplet, each of the pixel structures comprising:

a first scan line, disposed in a first direction for receiving a first driving voltage to move the droplet;

a data line, disposed in a second direction for receiving a high frequency pulse, wherein the first direction is perpendicular to the second direction;

a second scan line, disposed in the first direction for receiving a second driving voltage;

a readout line, disposed in the second direction for sensing a position of the droplet;

a first transistor, having a first end being connected to the data line, a second end being connected to a control electrode, and a control end being connected to the first scan line; and a second transistor, having a first end being connected to the readout line, a second end being connected to a sense unit, and a control end being connected to the second scan line.

2. The panel of claim 1, wherein, for each of the pixel structures:

the first scan line, the data line and the first transistor are formed in an array layer on a bottom substrate; and the second scan line, the readout line and the second transistor are formed in an array layer on a top substrate, wherein the droplet is located between the top layer and the bottom layer.

3. The panel of claim 2, wherein each of the pixel structures further comprises a color filter layer, wherein a projection area of the color filter layer is covered by the sense unit.

4. The panel of claim 1, wherein each of the pixel structures further comprises a common electrode, disposed under the control electrode in the first direction for providing a reference voltage.

5. The panel of claim 4, wherein the common electrode is disposed under the control electrode and the sense unit.

6. The panel of claim 1, wherein:

in a moving period, the first driving voltage is provided to the first scan line to move the droplet; and in a position determining period, the second driving voltage is provided to the second scan line, and the readout line senses the voltage difference of the sense unit.

* * * * *